US007868846B2

(12) United States Patent
Hur et al.

(10) Patent No.: US 7,868,846 B2
(45) Date of Patent: Jan. 11, 2011

(54) FREQUENCY RECONFIGURATION ARRAY ANTENNA AND ARRAY DISTANCE CONTROL METHOD

(75) Inventors: Moon man Hur, Seoul (KR); Soon Young Eom, Daejeon (KR); Young Bae Jung, Daejeon (KR); Soon Ik Jeon, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 227 days.

(21) Appl. No.: 12/141,740

(22) Filed: Jun. 18, 2008

(65) Prior Publication Data

US 2009/0040123 A1 Feb. 12, 2009

(30) Foreign Application Priority Data

Aug. 7, 2007 (KR) ..... 10-2007-0078920

(51) Int. Cl.
*H01Q 1/08* (2006.01)

(52) U.S. Cl. ..... 343/880; 343/833

(58) Field of Classification Search ..... 343/761, 343/827, 833, 834, 839, 844, 880, 893
See application file for complete search history.

(56) References Cited

U.S. PATENT DOCUMENTS 2,535,049 A * 12/1950 De Rosa ..... 343/880
3,383,694 A * 5/1968 Strohmeyer, Jr. ..... 343/833
6,176,723 B1 1/2001 Sakata et al.

FOREIGN PATENT DOCUMENTS

| | | |
|---|---|---|
| JP | 3-151701 | 6/1991 |
| JP | 10-190344 | 7/1998 |
| KR | 10-2004-0016492 | 2/2004 |
| KR | 10-2007-0117148 | 12/2007 |
| WO | WO 2007/142412 A1 | 12/2007 |

OTHER PUBLICATIONS

Gregory Junker et al., "Genetic Algorithm Optimization of Antenna Arrays with Variable Interelement Spacings" Antennas and Propagation Society International Symposium, 1998. IEEE, vol. 1, Jun. 21-26, 1998, pp. 50-53.

* cited by examiner

*Primary Examiner*—Michael C Wimer
(74) *Attorney, Agent, or Firm*—Rabin & Berdo, P.C.

(57) ABSTRACT

A frequency reconfiguration array antenna includes a first metal plate, and a first antenna element formed on the first metal plate and reconfiguring a frequency. An array antenna includes a second metal plate and a second antenna element formed on the second metal plate and reconfiguring a frequency. Further, the array antenna includes a connection plate being bent to connect the first metal plate and the second metal plate, and being bent to change the distance between the first metal plate and the second metal plate according to the frequency of the first and second antenna elements.

16 Claims, 5 Drawing Sheets

FREQUENCY RECONFIGURATION ARRAY ANTENNA AND ARRAY DISTANCE CONTROL METHOD

CROSS-REFERENCE TO RELATED APPLICATION

This application claims priority to and the benefit of Korean Patent Application No. 10-2007-0078920 filed in the Korean Intellectual Property Office on Aug. 7, 2007 the entire contents of which are incorporated herein by reference.

BACKGROUND OF THE INVENTION (a) Field of the Invention

The present invention relates to a frequency reconfiguring antenna array technique.

This work was supported by the IT R&D program of MIC/IITA [2007-F-041-01, Intelligent Antenna Technology Development].

(b) Description of the Related Art

A frequency reconfiguration antenna can vary antenna parameters such as frequency, polarization, and pattern by electrical or mechanical control, and a frequency reconfiguration antenna is reconfigured to be operable in at least two different frequency bandwidths. In this instance, when configuring the frequency reconfiguration antenna element as a frequency reconfiguration array antenna, the interval between elements is fixed with reference to a single frequency, in general, the center frequency of the intermediate bandwidth in the entire reconfiguration bandwidth.

In general, when a random frequency reconfiguration antenna is arranged, a radiation pattern of an array antenna is expressed in Equation 1.

$$P_{total}(\omega)=P_{element}(\omega)\times AF(\omega) \quad \text{(Equation 1)}$$

Here, $P_{total}(w)$ is a radiation pattern of the entire array antenna, $P_{element}(w)$ is a radiation pattern of the frequency reconfiguration antenna element which is a single element, and AF(w) is an array factor. The array factor is determined by a physical gap between frequency reconfiguration antenna elements, intensity ratio of signals supplied to the respective antenna elements, and phase difference. The radiation pattern and the array factor of the frequency reconfiguration antenna element are variable by the frequency, and hence the radiation pattern of the entire frequency reconfiguration array antenna is also variable by the frequency.

Therefore, when (N×M) antenna elements are arrayed and the amplitudes and phase of the signals supplied to the respective antenna elements are the same, the amplitude ratio and the phase difference between the radiation pattern of the antenna element and the supplied signal are determined, and hence the radiation pattern of the frequency reconfiguration array antenna is variable according to the physical distance between the antenna elements.

The array gain of the frequency reconfiguration array antenna is varied depending on the physical distance between the antenna elements, and when the distance is fixed with reference to a frequency bandwidth, the array gain of the frequency reconfiguration array antenna in another frequency bandwidth is reduced.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide high array gains in the entire reconfiguration bandwidths of a frequency reconfiguration array antenna.

In one aspect of the present invention, in a frequency reconfiguration array antenna, an array antenna includes: a first metal plate; a first antenna element being formed on the first metal plate and reconfiguring a frequency; a second metal plate; a second antenna element formed on the second metal plate and reconfiguring the frequency; and a connection plate being bent to connect the first metal plate and the second metal plate, and being bent to change a distance between the first metal plate and the second metal plate according to frequency of the first and second antenna elements.

In another aspect of the present invention, in a frequency reconfiguration array antenna, an array antenna includes: two metal plates; a plurality of antenna elements being formed on the two metal plates to form an array antenna, frequency bandwidths of the antenna elements being reconfigurable; and a connection plate for connecting the two metal plates, and varying a distance between two metal plates according to the reconfigured frequency bandwidth.

In another aspect of the present invention, a method for controlling a distance between a first antenna element formed on a first metal plate and a second antenna element formed on a second metal plate in a frequency reconfiguration array antenna includes: reconfiguring frequency bandwidths of the first and second antenna elements; and controlling a distance between the first metal plate and the second metal plate according to the reconfigured frequency bandwidth.

According to the exemplary embodiment of the present invention, a high array gain is provided by reconfiguring the frequency bandwidth of an antenna element and using an array structure for varying the array distance in a frequency reconfiguration array antenna.

DETAILED DESCRIPTION OF THE EMBODIMENTS

Figure 1:
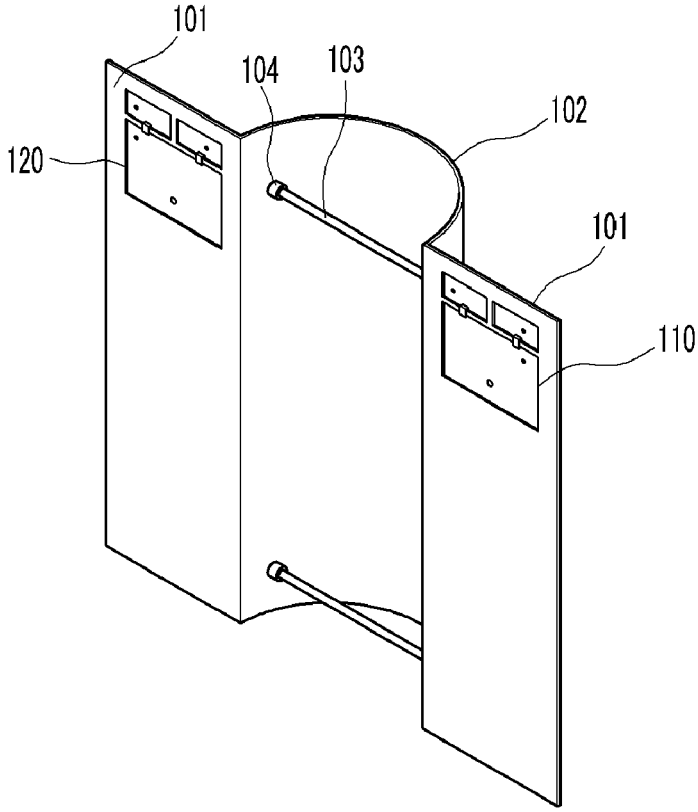
FIG. 1 is a front view of a frequency reconfiguration array antenna according to an exemplary embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Throughout this specification and the claims which follow, unless explicitly described to the contrary, the word "comprising" and variations such as "comprises" will be understood to imply the inclusion of stated elements but not the exclusion of any other elements.

A frequency reconfiguration array antenna according to an exemplary embodiment of the present invention will now be described in detail with reference to FIG. 1 to FIG. 5.

Figure 2:
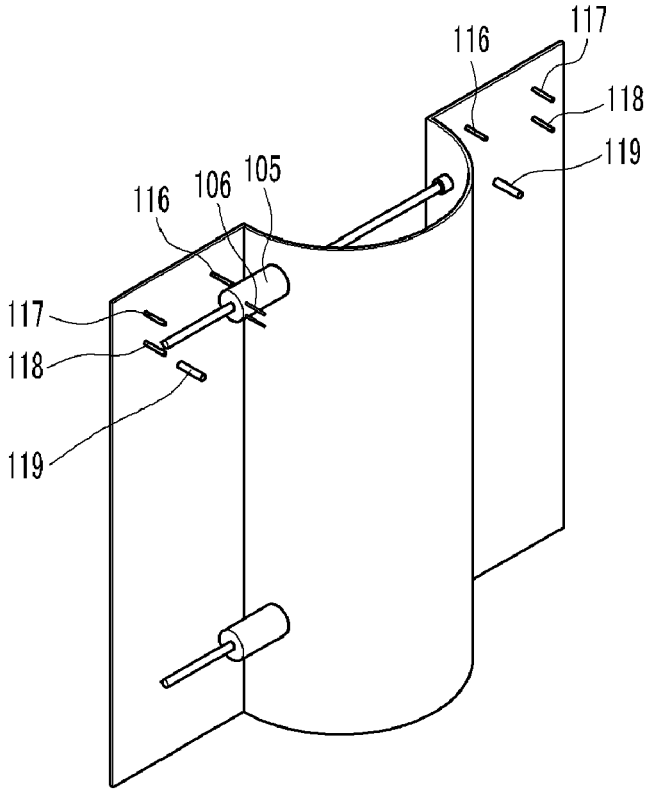
FIG. 2 is a rear view of a frequency reconfiguration array antenna according to an exemplary embodiment of the present invention.
Figure 3:
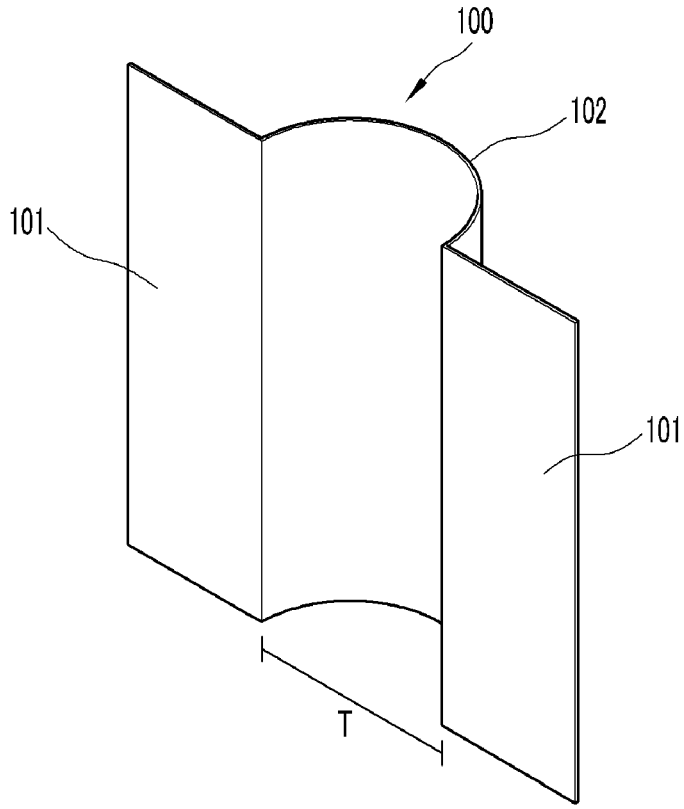
FIG. 3 shows a brief case in which the distance between two metal plates is long in an implementation of FIG. 1.
Figure 4:
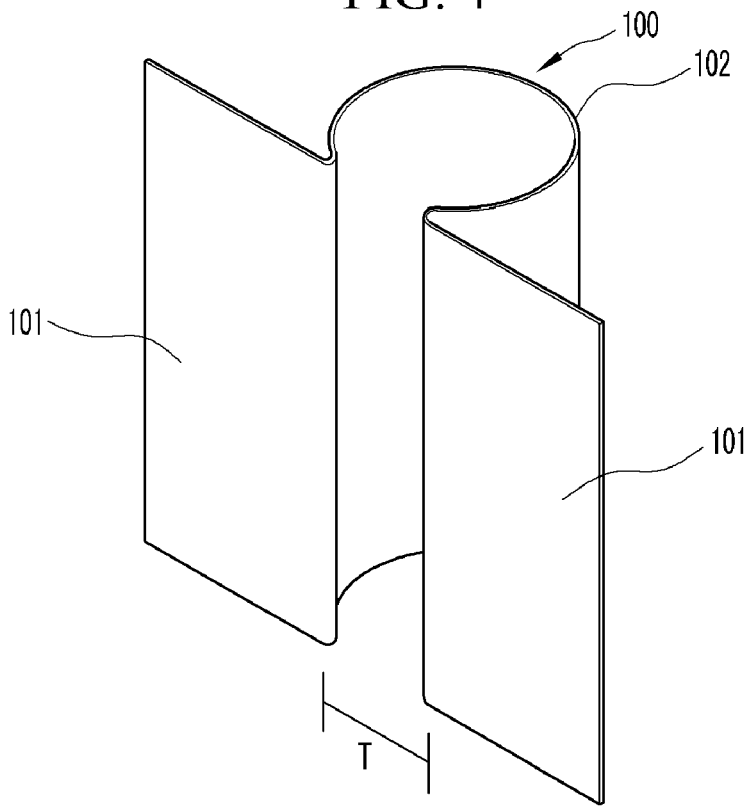
FIG. 4 shows a brief case in which the distance between two metal plates is short in an implementation of FIG. 1.
Figure 5:
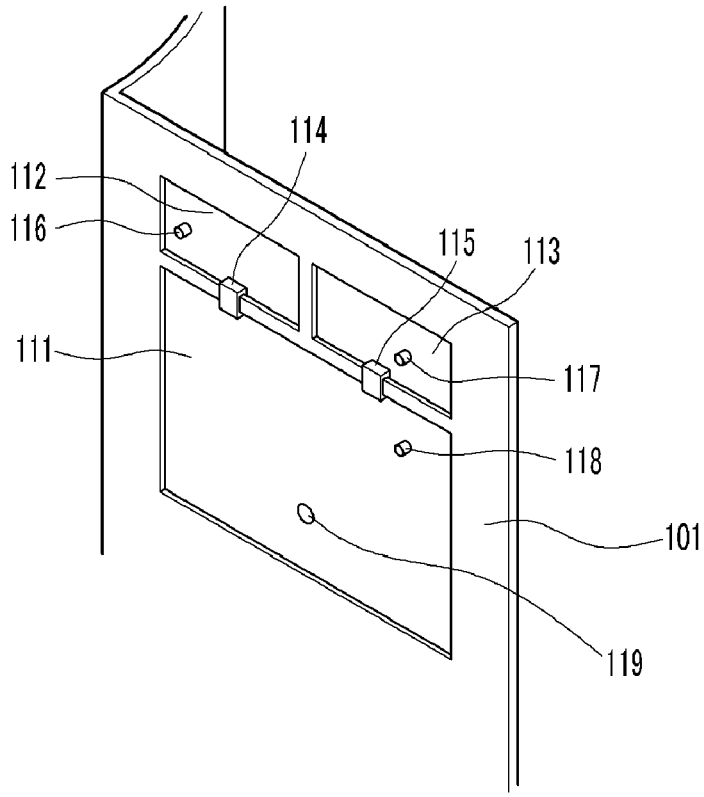
FIG. 5 is an antenna element shown in FIG. 1.

FIG. 1 is a front view of a frequency reconfiguration array antenna according to an exemplary embodiment of the present invention, and FIG. 2 is a rear view of a frequency reconfiguration array antenna according to an exemplary embodiment of the present invention. FIG. 3 shows a brief case in which the distance between two metal plates is long in an implementation of FIG. 1, and FIG. 4 shows a brief case in which the distance between two metal plates is short in an implementation of FIG. 1. FIG. 5 is an antenna element according to an exemplary embodiment of the present invention.

As shown in FIG. 1 and FIG. 2, the frequency reconfiguration array antenna includes an implement 100 in FIG. 3, a plurality of antenna elements 110 and 120, a post 103, a fixed ring 104, a linear motor 105, a linear motor control power unit 106, DC power units 116, 117, and 118, and a radio frequency (RF) power unit 119, and the implement 100 includes two metal plates 101 and connection plate 102.

The antenna elements 110 and 120 are respectively formed on the two metal plates 101, and the antenna elements 110 and 120 formed on the two metal plates 101 configure a pair. The metal plate 101 is formed as a surface and functions as a reflector of the antenna elements 110 and 120. In this instance, when N antenna elements are on the metal plates 101, the frequency reconfiguration array antenna has an (N×2)-array antenna element according to the two metal plates 101. For ease of description, a (1×2)-array frequency reconfiguration array antenna in which one of the antenna elements 110 and 120 is formed on each metal plate will be exemplified in FIG. 1.

The connection plate 102 is bent to connect the two metal plates 101, and it is made of metallic material that is easily bent so as to vary the distance in the horizontal direction between the two metal plates 101. In this instance, the distance T between the two metal plates 101 is changed as shown in FIG. 3 and FIG. 4 when the connection plate 102 is bent, so that the distance between the two antenna elements 110 and 120 may be changed.

The post 103 is extended in the horizontal direction through a bent side of the connection plate 102 so that the two metal plates 101 may be moved in the horizontal direction when the connection plate 102 is bent. The fixed ring 104 is formed in the bent space of the connection plate 102 to fix the post 103 on the connection plate 102.

In this instance, the linear motor 105 connected to the post 103 rotates the post 103 so that the connection plate 102 may be bent by the fixed ring 104 and the post 103.

As shown in FIG. 5, the antenna elements 110 and 120 include a basic radiator 111, parasitic elements 112 and 113, switches 114 and 115, DC power units 116, 117, and 118, and a radio frequency power unit 119.

The basic radiator 111 and the parasitic elements 112 and 113 are separately arranged on the metal plate 101. The basic radiator 111 and the parasitic element 112 are connected by the switch 114, and the basic radiator 111 and the parasitic element 113 are connected by the switch 115.

Here, the switches 114 and 115 include a PIN diode, a transistor, and a micro-electromechanical system (MEMS). In FIG. 5, two switches 114 and 115 are illustrated to connect the respective parasitic elements 112 and 113 and the basic radiator 111, and further, the number of the switches 114 and 115 is changeable.

Referring to FIG. 1 to FIG. 5, the DC power units 116, 117, and 118 are connected to the basic radiator 111 and the parasitic elements 112 and 113 through the rear side of the metal plate 101, and the DC power units 116, 117, and 118 supply a DC voltage to the basic radiator 111 and the parasitic elements 112 and 113 so as to reconfigure the operational frequency of the antenna elements 110 and 120. In this instance, the radio frequency power unit 119 is connected to the basic radiator 111 through the rear side of the metal plate 101. Then, depending on the on/off states of the switches 114 and 115, the parasitic elements 112 and 113 are not connected to the basic radiator 111, the parasitic element 112 or the parasitic element 113 is connected thereto, or the parasitic elements 112 and 113 are connected thereto. Accordingly, the energy applied to the basic radiator 111 can be supplied to the parasitic elements 112 and 113 by the radio frequency power unit 119 according to the connection state of the parasitic elements 112 and 113 to the basic radiator 111. That is, the physical shape of the entire radiator to which the radio frequency power unit 119 is applied is varied according to the on/off state of the switches 114 and 115, and the operational frequency is then determined. Through this process, the operational frequency of the antenna element is reconfigured.

In this instance, when the operational frequency of the antenna elements 110 and 120 is reconfigured, linear power from the motor control power unit 106 is supplied to operate the linear motor 105. The post 103 connected to the linear motor 105 is rotated in correspondence to the frequency reconfigured by the antenna elements 110 and 120 so that the connection plate 102 is bent by the fixed ring 104 and the post 103. That is, the array distance of the antenna elements 110 and 120 arranged on the metal plate 101 is controlled by the connection plate 102 that is bent in correspondence to the frequency reconfigured by the antenna elements.

When the switches 114 and 115 are turned on, the basic radiator 111 and the parasitic elements 112 and 113 are connected with each other, and the antenna elements 110 and 120 according to the exemplary embodiment of the present invention configure a first frequency bandwidth (0.8 to 0.9 GHz). When the switch 114/115 is turned on and the switch 115/114 is turned off, the basic radiator 111 and the parasitic element 112/113 are connected with each other and the antenna elements 110 and 120 configure a second frequency bandwidth (1.7 to 2.5 GHz). Also, when the switches 114 and 115 are turned off, the antenna elements 110 and 120 configure a third frequency bandwidth (3.4 to 3.6 GHz) according to the operation by the basic radiator 111.

A frequency bandwidth and an array distance of a frequency reconfiguration array antenna according to an exemplary embodiment of the present invention will now be described with reference to FIG. 6 to FIG. 9.

Figure 6:
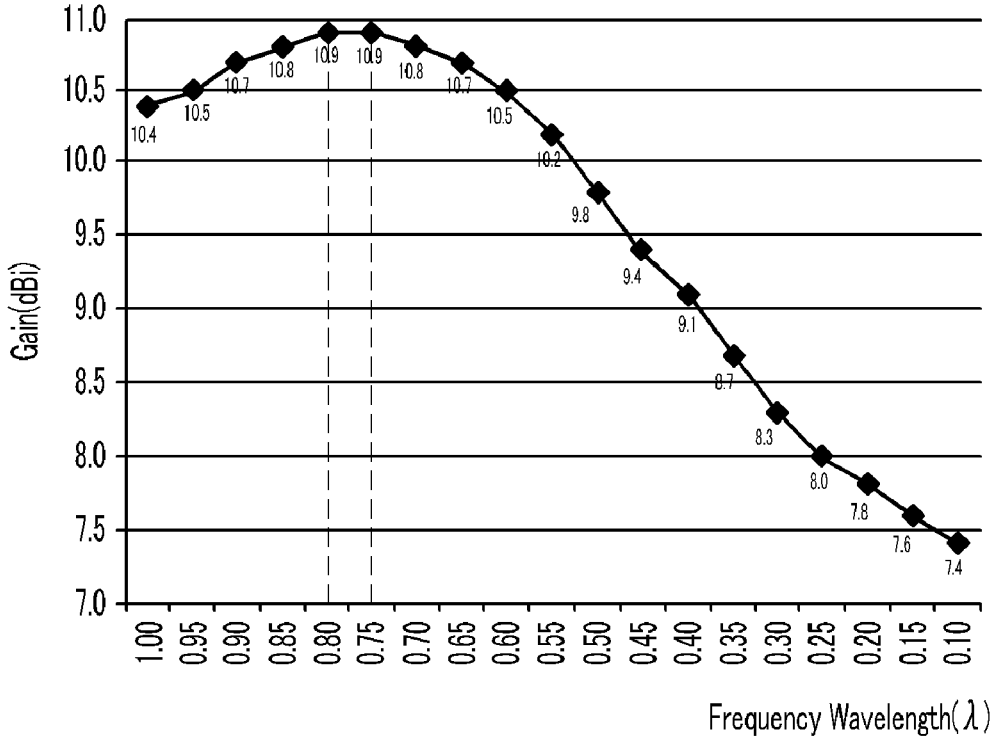
FIG. 6 is a graph of showing changes of the gain according to the array distance in a (1×2) array antenna.
Figure 7:
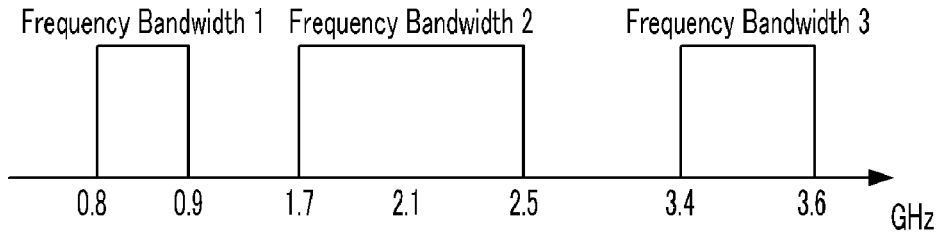
FIG. 7 shows a frequency bandwidth reconfigured in a frequency reconfiguration array antenna according to an exemplary embodiment of the present invention.

FIG. 6 is a graph of showing changes of the gain according to the array distance in a (1×2) array antenna, and FIG. 7 shows a frequency bandwidth reconfigured in a frequency reconfiguration array antenna according to an exemplary embodiment of the present invention.

Referring to FIG. 6, as an exemplary embodiment, a patch antenna having an operational frequency of 1.0 GHz and a width and a height of 10 cm is arranged in a (1×2) array, and the array distance of the two antenna elements is controlled at intervals of 0.1 λ from 0.1 times (3 cm) to 1.0 times (30 cm) the operational frequency wavelength (λ=30 cm), thereby calculating the gain of the array antenna.

As shown in FIG. 6, the gain of the array antenna according to the array distance of the two antenna elements is varied from 7.4 dBi to 10.9 dBi, and it has the highest array gain in the 0.75 λ-0.8 λ frequency wavelength. Here, when the array distance between the two antenna elements is narrower than the array distance between the antenna elements with the highest array gain, energy between the antennas is over-coupled. On the contrary, when the array distance between the two antenna elements is wider than the array distance between the antenna elements with the highest array gain, energy between the antennas is under-coupled. Therefore, when the array distance between the two antenna elements is changed to be wider or narrower than the array distance established by 0.75 λ-0.8 λ of the center frequency of the frequency bandwidth, the radiation pattern characteristic of the antenna element is degraded and the high array gain cannot be acquired.

That is, the array distance between the two antenna elements can acquire the highest array gain by setting the array distance to correspond to 0.75 λ-0.8 λ of the center frequency wavelength of the reconfigured frequency bandwidth.

As shown in FIG. 7, it is assumed that the respective antenna elements of the frequency reconfiguration array antenna according to the exemplary embodiment of the present invention can reconfigure the first frequency bandwidth (0.8-0.9 GHz), the second frequency bandwidth (1.7-2.5 GHz), and the third frequency bandwidth (3.4 to 3.6 GHz).

When the antenna element reconfigures the frequency bandwidth with the first frequency bandwidth (0.8 to 0.9 GHz), the linear motor 105 bends the connection plate 102 through the post 103 to change the array distance of the two antenna elements 110 and 120 to 26.5 cm that corresponds to 0.75 λ of the center frequency 0.85 GHz of the first frequency bandwidth (0.8 to 0.9 GHz). When the antenna element reconfigures the frequency bandwidth with the second frequency bandwidth (1.7 to 2.5 GHz), the linear motor 105 bends the connection plate 102 through the post 103 to change the array distance of the two antenna elements 110 and 120 to 10.7 cm that corresponds to 0.75 λ of the center frequency 2.1 GHz of the second frequency bandwidth (1.7 to 2.5 GHz). Also, when the antenna element reconfigures the frequency bandwidth with the third frequency bandwidth (3.4 to 3.6 GHz), the linear motor 105 bends the connection plate 102 through the post 103 to change the array distance of the antenna elements 110 and 120 to 6.4 cm that corresponds to 0.75 λ of the center frequency 3.5 GHz of the third frequency bandwidth (3.4 to 3.6 GHz). That is, the array structure can be reconfigured so that the array distance may be physically varied as the antenna element reconfigures the frequency bandwidth. Changes of the gain in the reconfigured frequency bandwidth will now be described with reference to FIG. 8 and FIG. 9.

Figure 8:
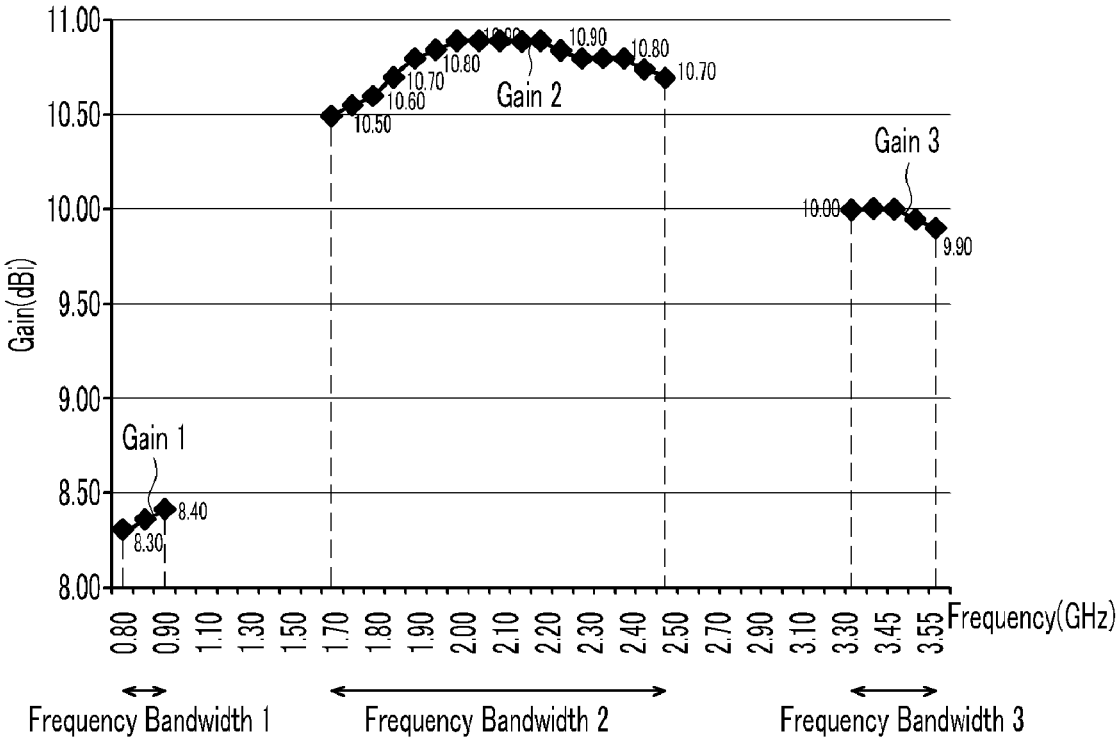
FIG. 8 is a graph showing changes of the gain in the case of using a fixed array distance in a (1×2) array antenna.
Figure 9:
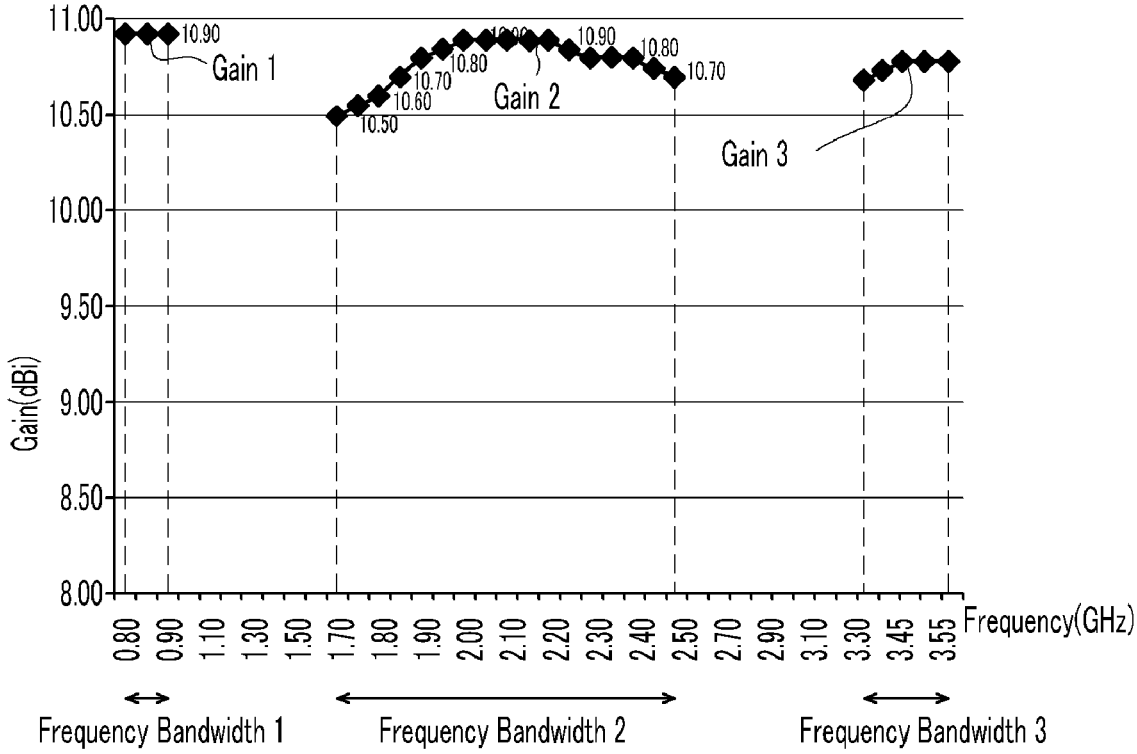
FIG. 9 is a graph of showing changes of the gain in the case of varying an array distance in a frequency bandwidth shown in FIG. 7.

FIG. 8 is a graph of showing changes of the gain in the case of using a fixed array distance in a (1×2) array antenna. FIG. 9 is a graph of showing changes of the gain in the case of varying an array distance in a frequency bandwidth shown in FIG. 7 according to an exemplary embodiment of the present invention.

In FIG. 8, the array distance of the two antenna elements is fixed to be 10.7 cm that corresponds to 0.75 λ of the center frequency 2.1 GHz of the second frequency bandwidth (1.7 to 2.5 GHz), and it indicates the array gain of the corresponding frequency reconfiguration band.

As shown in FIG. 8, the first gain in the first frequency bandwidth (0.8 to 0.9 GHz) is 8.3 to 8.4 dBi in the frequency bandwidth reconfigured in the frequency reconfiguration array antenna. The second gain in the second frequency bandwidth (1.7 to 2.5 GHz) is 10.5 to 10.9 dBi, and the third gain in the third frequency bandwidth (3.4 to 3.6 GHz) is 9.9 to 10.0 dBi.

Since the array distance is fixed as 10.7 cm in the first frequency bandwidth (0.8 to 0.9 GHz) having a long frequency wavelength, the energy between the two antenna elements is over-coupled. Since the array distance is fixed as 10.7 cm in the third frequency bandwidth (3.4 to 3.6 GHz) having a short frequency wavelength, the energy between the two antenna elements is under-coupled. That is, when the array distance is determined according to one of the frequency bandwidths, the array gain of the other frequency bandwidth is problematically reduced. In order to solve the problem, a method for changing the array distance according to the frequency bandwidth will now be described with reference to FIG. 9.

As shown in FIG. 9, the first gain in the first frequency bandwidth (0.8 to 0.9 GHz) is 10.9 dBi from among the frequency bandwidth reconfigured in the frequency reconfiguration array antenna. The second gain in the second frequency bandwidth (1.7 to 2.5 GHz) is 10.5 to 10.9 dBi, and the third gain in the third frequency bandwidth (3.4 to 3.6 GHz) is 10.8 to 10.9 dBi.

In the first frequency bandwidth (0.8 to 0.9 GHz) having a long frequency wavelength, the array distance is set to be 26.5 cm that corresponds to 0.75 λ of the center frequency 0.85 GHz of the first frequency bandwidth (0.8 to 0.9 GHz), and hence it has the array gain (10.9 dBi) that is higher than the array gain (8.3 to 8.4 dBi) in the first frequency bandwidth (0.8 to 0.9 GHz) of FIG. 8. In the third frequency bandwidth (3.4 to 3.6 GHz) having a short frequency wavelength, the array distance is set to be 6.4 cm that corresponds to 0.75 λ of the center frequency 3.5 GHz of the third frequency bandwidth (3.4 to 3.6 GHz), and it has the array gain (10.8 to 10.9 dBi) that is higher than the array gain (9.9 to 10.0 dBi) in the third frequency bandwidth (3.4 to 3.6 GHz) of FIG. 8. That is, high array gains can be acquired in the respective frequency bandwidths by varying the array distance according to the frequency bandwidth.

Figure 10:
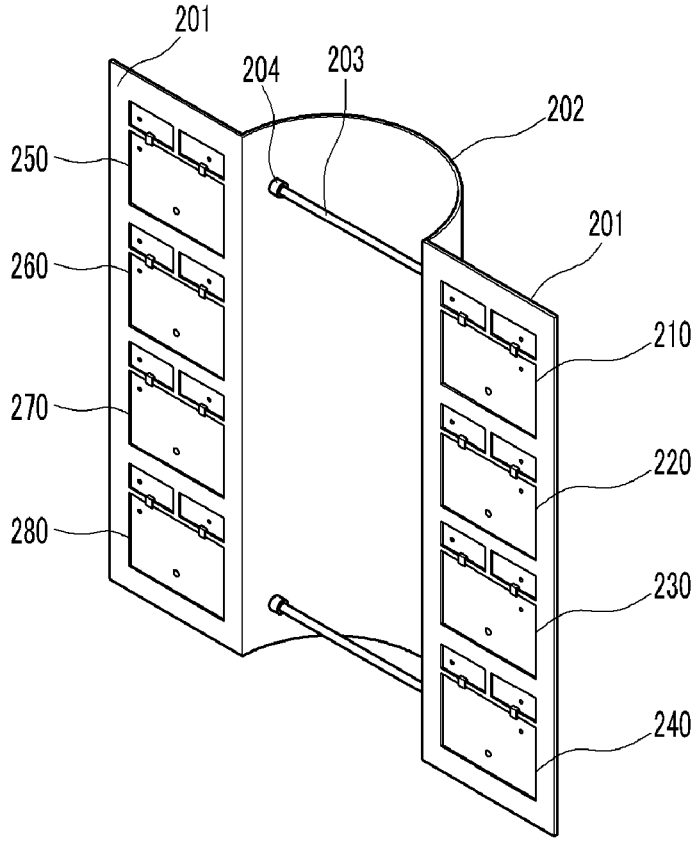
FIG. 10 is a frequency reconfiguration array antenna according to an exemplary embodiment of the present invention.

The (1×2)-array frequency reconfiguration array antenna has been described in the exemplary embodiment of the present invention, and the present invention is applicable to a frequency reconfiguration array antenna having other arrays. For example, as shown in FIG. 10, in the (4×2)-array frequency reconfiguration array antenna, the linear motor (not shown) can bend the connection plate 202 through the post 203 to change the array distance between the two antenna elements configuring another pair according to the operational frequency of the respective antenna elements 210 to 280.

Accordingly, in the exemplary embodiment of the present invention, the array structure can be reconfigured by reconfiguring the frequency bandwidth of the antenna element so as to vary the array distance, and the high array gain is acquired.

The above-described embodiments can be realized through a program for realizing functions corresponding to the configuration of the embodiments or a recording medium for recording the program in addition to through the above-described device and/or method, which is easily realized by a person skilled in the art.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. In a frequency reconfiguration array antenna, an array antenna comprising:

a first metal plate;

a first antenna element being formed on the first metal plate and reconfiguring a frequency;

a second metal plate;

a second antenna element formed on the second metal plate and reconfiguring the frequency; and a connection plate being bent to connect the first metal plate and the second metal plate, and being bent to change a distance between the first metal plate and the second metal plate according to frequency of the first and second antenna elements.

2. The array antenna of claim 1, further comprising a post being extended through a bent surface of the connection plate, and being rotated to bend the connection plate.

3. The array antenna of claim 2, further comprising a linear motor for rotating the post according to the frequency.

4. The array antenna of claim 3, further comprising a fixed ring for fixing the post on the connection plate, the fixed ring being formed on the opposite surface of the surface on the connection plate on which the linear motor is formed.

5. The array antenna of claim 1, wherein the first and second antenna elements further include:

a basic radiator for receiving DC power for reconfiguring the frequency;

a parasitic element for receiving the DC power, the parasitic element being separated from the basic radiator; and a switch for connecting the basic radiator and the parasitic element.

6. The array antenna of claim 5, wherein the switch includes one of a PIN diode, a transistor, and a micro-electromechanical system (MEMS).

7. The array antenna of claim 1, wherein the first and second metal plates function as reflectors of the first and second antenna elements.

8. The array antenna of claim 1, wherein an array distance between the first antenna element and the second antenna element is changed by changing a distance between the first metal plate and the second metal plate.

9. The array antenna of claim 1, wherein the array distance between the first antenna element and the second antenna element corresponds to 0.75 to 0.8 times the frequency wavelengths of the first and second antenna elements.

10. In a frequency reconfiguration array antenna, an array antenna comprising:

two metal plates;

a plurality of antenna elements being formed on the two metal plates to form an array antenna, frequency bandwidths of the antenna elements being reconfigurable; and a connection plate for connecting the two metal plates, the connection plate having a first end connected to one of the two metal plates and a second end connected to the other one of the two metal plates, wherein a distance between the first and second ends of the connection plate changes, to vary a distance between the two metal plates according to the reconfigured frequency bandwidth.

11. The array antenna of claim 10, wherein the antenna element changes the array distance between the plurality of antenna elements by changing the distance between the two metal plates according to the reconfigured frequency bandwidth.

12. A method for controlling a distance between a first antenna element formed on a first metal plate and a second antenna element formed on a second metal plate in a frequency reconfiguration array antenna, the first metal plate being connected to a first end of a connection plate, the second metal plate being connected to a second end of the connection plate, the method comprising:

reconfiguring frequency bandwidths of the first and second antenna elements; and controlling a distance between the first and second ends of the connection plate to control a distance between the first metal plate and the second metal plate according to the reconfigured frequency bandwidth.

13. The method of claim 12, wherein the step of reconfiguration includes:

supplying a first power to a basic radiator and a parasitic element configuring the first and second antenna elements; and controlling on/off of a switch for connecting the basic radiator and the parasitic element.

14. The method of claim 12, wherein the step of controlling further includes controlling the distance between the first and second antenna elements by changing the distance between the first and second metal plates according to the reconfigured frequency bandwidth.

15. The method of claim 12, wherein the first power is DC power, and the basic radiator is connected to a radio frequency (RF) power unit.

16. The method of claim 12, wherein the step of controlling includes:

controlling the distance between the first and second metal plates so that the distance between the first and second antenna elements may correspond to 0.75 to 0.8 times the center frequency wavelengths of the frequency bandwidths of the first and second antenna elements.

* * * * *